United States Patent [19]

Janzen

[11] 4,415,005

[45] Nov. 15, 1983

[54] PIPE THREAD PROTECTOR DEVICE

[76] Inventor: Harlo W. Janzen, Box 356, Fairview, Okla. 73737

[21] Appl. No.: 287,499

[22] Filed: Jul. 27, 1981

[51] Int. Cl.[3] ..... F16L 57/00

[52] U.S. Cl. ..... 138/96 T; 138/89

[58] Field of Search ..... 138/89, 96 R, 96 T

[56] References Cited

U.S. PATENT DOCUMENTS

| | | | |
|---|---|---|---|
| 2,315,538 | 4/1943 | Moeller | 138/89 |
| 2,547,992 | 4/1951 | Baker | 138/96 T |
| 2,937,666 | 5/1960 | Maisch | 138/89 |
| 2,993,616 | 7/1961 | Carlile et al. | 138/89 |
| 3,038,502 | 6/1962 | Hauk et al. | 138/96 T |
| 3,749,131 | 7/1973 | Burger | 138/89 |
| 3,860,037 | 1/1975 | Rowe | 138/89 |
| 3,964,754 | 6/1976 | Murai et al. | 138/89 |
| 4,266,578 | 5/1981 | Swain et al. | 138/96 R |

*Primary Examiner*—John W. Shepperd
*Attorney, Agent, or Firm*—William R. Laney

[57] ABSTRACT

A device for protecting threads on a pipe which includes an annular elastomeric sleeve dimensioned to fit around the outside of the pipe in a thread protective position, a plate extending transversely across one end of the elastomeric sleeve and acting as a stop limiting axial movement of the sleeve on the pipe, and a radially expansible internal gripping subassembly for selectably gripping the inside surface of the pipe to retain the thread protector device in operative position. The radially expansible, internal gripping subassembly includes, as a part thereof, a camming handle which is used to actuate an axially projecting shaft by cam action and to thus place the subassembly in compression, thereby causing an elastomeric material forming a part thereof to expand radially onwardly and frictionally engage the interior of the pipe.

9 Claims, 10 Drawing Figures

PIPE THREAD PROTECTOR DEVICE

FIELD OF THE INVENTION

This invention relates to apparatus for protecting pipe threads from damage.

BRIEF DESCRIPTION OF THE PRIOR ART

The following is a prior art statement in compliance with the guidance and requirements of 37 C.F.R. §§1.56, 1.97 and 1.98.

In the production of oil and gas from deep subterranean locations, it is necessary to employ elongated strings of drill pipe, production tubing or casing made up of multiple sections of tubular members axially interconnected at threaded joints. These strings are usually at least one mile in length and sometimes exceed four miles in length. Because of the resultant great stress imposed upon them, it is therefore of great importance that the pipe threads used to interconnect sections be undamaged and formed in true concentricity around the pipe. Since drill pipe and casing are subjected to rough treatment during handling and making up string, it is easy for the threaded end portions at the end of each tubular section to become damaged by impact with other objects. Accordingly, various devices have been used to surround and cover the pipe threads, thus protecting and shielding the threads from impact with various objects until the time the joint connections are made.

One patent known to me which is directed to a sleeve protector having some general similarity to that which I have invented is U.S. Pat. No. 2,161,197 issued to Protin. The Protin patent thread protector includes a sleeve portion which is dimensioned to surround an external thread on a pipe end, and which may be caused to engage the pipe to protect the threads thereof by means of a cam mechanism. The cam mechanism includes a lever carrying a cam-like surface on one end which engages a plate extending across the sleeve. A bar is attached to the cam lever and extends into the interior of the pipe to there engage a bendable strut. By causing the cam surface to engage the plate, the strut can be bent to a position in which it grips the internal surface of the pipe to thereby hold the thread protector in place with the sleeve surrounding the threads on the outer side of the pipe.

Baker U.S. Pat. No. 2,547,992 relates to an apparatus for protecting pipe threads, which apparatus includes a cam surface which can be caused to bear against a ball at one end of a bar so as to cause lateral displacement of pins located internally of the pipe against the interior of the pipe, and thereby retain the protector in place on the pipe. A patent generaly similar to this Baker patent is a second patent issued to Baker, i.e. U.S. Pat. No. 2,513,613.

In FIGS. 12 through 16 of Hauk et al. U.S. Pat. No. 3,038,502, a rubber external sleeve is illustrated as a part of a thread protector, and this external sleeve encloses a steel reinforcing band to enhance the structural strength of the external sleeve. The external sleeve is fixed around the pipe to afford protection to the threads.

Mickelson U.S. Pat. No. 2,727,651 shows a thread protector having a rubber external sleeve and a rubber internal element positioned to frictionally engage the inner side of the pipe and thereby hold the protector in place.

In Zinn U.S. Pat. No. 2,707,387, retention of the thread protector in position around the pipe is accomplished by means of an internally located compressible rubber block or plug. The plug is compressed to cause it to expand radially into engagement with the internal wall of the pipe.

It is with respect to the foregoing described prior art patents that the present invention consitutes an improvement facilitating ease of installation for use, and subsequent quick disconnect removal of the thread protector from the pipe end.

GENERAL DESCRIPTION OF THE PRESENT INVENTION

The present invention provides an improved pipe thread protector device which includes an annular elastomeric sleeve dimensioned to surround a pipe thread to be protected. Toward one end of the sleeve, a radially inwardly projecting stop flange or plate means is provided to limit movement of the sleeve axially over the pipe end. A radially expandable internal gripping subassembly is attached to the sleeve and projects into the interior of the pipe for selective expansion and gripping of the pipe which carries the thread to be protected.

The radially expandable internal gripping subassembly includes one or more bodies of elastomeric material, such as rubber, which fit within the pipe through the open end thereof, and which, in the unstressed or relaxed state, define a clearance or space with the internal wall of the pipe. Means is provided to apply an axial compressive or squeezing force to the internal body of elastomeric material to cause it to expand in a radial direction into gripping engagement with the pipe.

The compressive force applying means includes a compression shaft which projects generally axially within the thread protector device, and a camming arm connected to the compression shaft and operative upon pivotation to cause axial movement of the compression shaft in a selected one of opposite directions to either engage the protector with the pipe, or disengage it therefrom.

An important object of the invention is to provide a pipe thread protector apparatus which can be very quickly and easily placed in a protective position over the threaded end of a pipe to shield and protect the threads carried thereon, and which can be quickly and easily removed from the pipe when the threads are to be engaged in making up a joint.

Another object of the invention is to provide a pipe thread protector device which can be manually secured and positioned to protect the threads on a pipe end, and can be quickly detached when the threads are to be engaged in forming a joint.

A further object of the invention is to provide a pipe thread protector which is mechanically rugged and durable, yet relatively simple in its mechanical and functional makeup, and which is characterized in having a long and trouble-free operating life.

Additional objects and advantages of the invention will become apparent as the following detailed description of preferred embodiments of the invention is read in conjunction with the accompanying drawings which illustrate such preferred embodiments.

GENERAL DESCRIPTION OF THE DRAWINGS

DETAILED DESCRIPTION OF PREFERRED EMBODIMENTS OF THE INVENTION

Figure 1:
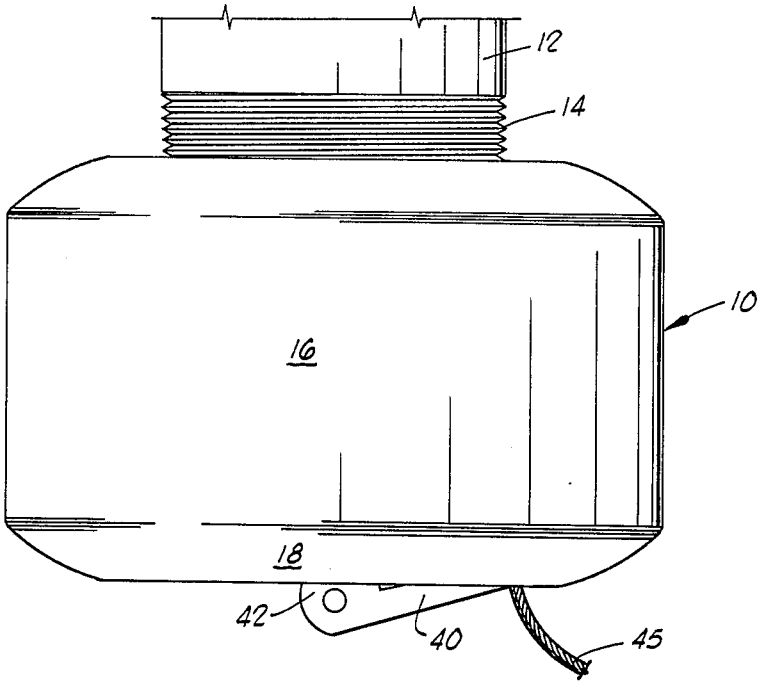
FIG. 1 is a side elevational view of a pipe thread protector constructed in accordance with one embodiment of the invention as the same appears when secured over the end of a pipe in a thread protecting position.
Figure 2:
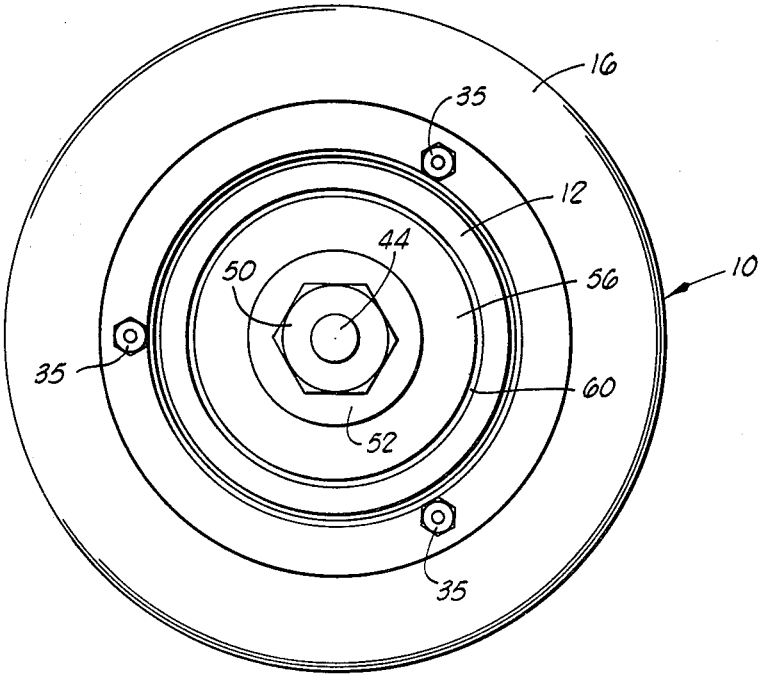
FIG. 2 is a plan view of the thread protector device illustrated in FIG. 1 as the same appears when detached from the pipe carrying the thread to be protected.
Figure 3:
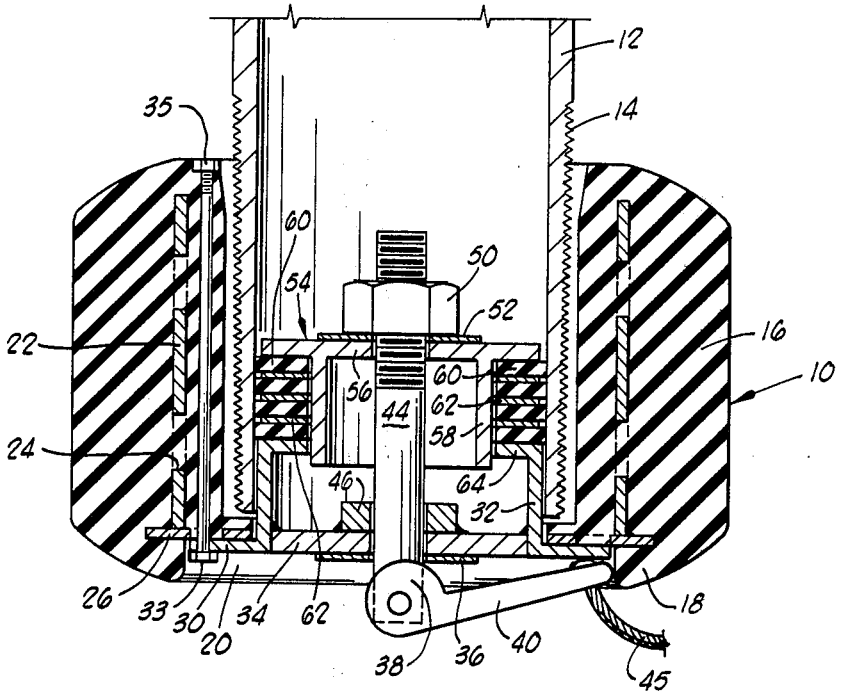
FIG. 3 is a vertical sectional view through the pipe thread protector device while it is in its operative position on a threaded pipe end with the sectional view taken approximately along the diametric center line of the thread protector deivce.

Referring initially to FIG. 1 of the drawings, one embodiment of the pipe thread protector device constructed in accordance with the invention is there illustrated and is designated generally by reference numeral 10. The pipe thread protector device 10 is shown in an operative position of engagement with the end of an externally threaded pipe 12 which carries helical pipe threads 14. As shown in FIG. 3, the thread protector device includes an annular sleeve 16 constituted of a body of elastomeric material such as rubber. It will be noted in referring to FIG. 3 that the sleeve 16 is formed integrally with an axially extending skirt 18 located at one end of the sleeve and defining interiorly thereof, an opening or bore 20.

The sleeve 16 has embedded therein an axially extending, annular metallic reinforcing tube 22. The reinforcing tube 22 is provided with a plurality of perforations or apertures 24 therethrough to facilitate engagement with the body of elastomeric material in the sleeve 16. At its lower end, the reinforcing tube 22 is welded or otherwise suitably secured to an annular plate 26. The outer peripheral edge portion of the annular plate 26 projects into the body of elastomeric material making up the sleeve 16. The annular plate 26 is fastened to the inner side of an annular base flange 30 formed on the lower end of a rigid internal sleeve 32 which is diametrically dimensioned to facilitate insertion, with clearance, into the open end of the pipe section 12. For the purpose of retaining the rigid internal sleeve 32 secured to the elastomeric sleeve 16, a plurality of elongated bolts 33 are provied and extend through aligned apertures formed in the base flange 30, the annular plate 26 and the elastomeric body to the upper side thereof where the threaded ends of these elongated bolts are engaged by securing nuts 35. Secured across the open throat of the rigid, internal sleeve 32 is a web plate 34.

Figure 4:
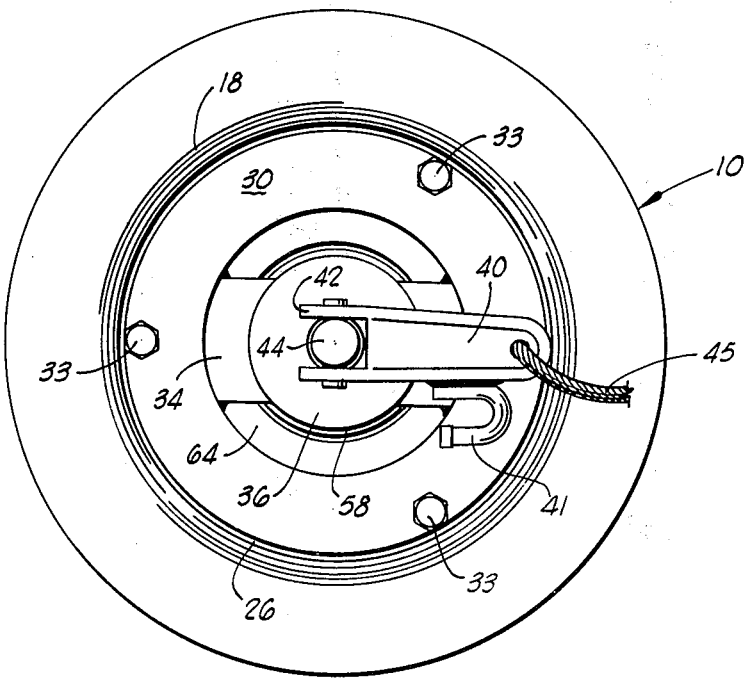
FIG. 4 is a bottom plan view of the embodiment of the pipe thread protector device illustrated in FIG. 1.

A cam disc 36 is secured to the outer side of the web plate 34 and acts as a cam surface against which a cam lobe 38 carried on one of a camming arm 40 bears during the installation of the pipe thread protector device, and engagement thereof with the pipe 12 carrying a thread to be protected. As will be perceived in referring to FIG. 4, the camming arm 40 includes a bifurcated end portion 42 upon which the cam lobe 38 is located and which receives between opposed legs and within the bifurcation, one end of an elongated compression shaft 44. A lanyard 45 is secured to the opposite end of the camming arm 40 from the bifurcated end portion 42. The compression shaft 44 extends through an aperture formed in the cam disc 36 and through aligned apertures formed in the base web plate 34 and through a guide washer 46 secured to the opposite side of the web plate 34 from the cam disc.

The compression shaft 44 is oriented to extend coaxially within the pipe 12 and terminates at its end opposite the end connected to the camming arm 40 in a threaded end portion which threadedly receives a compression nut 50 and compression washer 52. The compression washer 52 rests upon the inner side of an axially moveable compression element designated generally by reference numeral 54. The compression element 54 includes a compression plate 56 having a central aperture to accommodate passage of the compression shaft 44 therethrough, and also includes an axially extending annular cage element 58.

The cage element 58 functions to concentrically locate, with respect to the axis of the thread protector device and the pipe upon which it is mounted, a plurality of expandable elastomeric gripping discs 60. The gripping discs 60 are stacked in superimposed relation, but are separated from each other by a plurality of annular metallic washers 62. The axially outermost of the gripping discs 60 rests upon a radially inwardly directed flange 64 formed at the upper end of the rigid internal sleeve 32, and which defines a central opening adequate to permit reciprocating axial movement of the annular cage element 58.

OPERATION OF THE EMBODIMENT OF THE INVENTION ILLUSTRATED IN FIGS. 1–4

It is assumed that initially the thread protector device of the invention is out of use or not positioned in its thread protective position on a pipe. Prior to placing it on a pipe end in order to protect the thread carried thereon, the camming arm 40 is pivoted downwardly from its position illustrated in FIGS. 1 and 3 so that it projects predominantly axially with respect to the axis of the thread protector. When the camming arm 40 is thus pivoted, the cam lobe 38 is moved with respect to the cam disc 36 so as to allow the compression shaft 44 to move freely in an axial direction with respect to the annular sleeve 16. Upon pivotation of the camming arm 40 in the manner described, the natural resilience of the elastomeric gripping discs 60 will cause them to contract radially and expand axially, thus displacing the annular cage element 58 and the compression plate 56 axially inwardly in the sleeve 16.

With the relaxation and contraction of the gripping discs 60, they assume an outside diametric dimension such that the thread protector device can be placed over the end of a pipe by inserting the inner or central portion of the device through the pipe opening and into the interior of the pipe. The sleeve 16 is concurrently passed over the outer end of the pipe until it assumes the position shown in FIG. 3 of the drawings. It will be perceived that in this position of the pipe thread protector device 10, the sleeve 16 surrounds and protectively encompasses the threads 14 carried on the end of the pipe section 12. The protector device 10 is moved axially onto the pipe until the end of the pipe abuts the small amount of elastomer which projects radially inwardly on the upper surface of the annular plate 26.

When the protector device has thus been positioned and seated, the camming arm 40 is then pivoted back to the locking position, which is the position of the camming arm illustrated in FIGS. 1 and 3 of the drawings. This pivotal movement of the camming arm 40 causes the cam lobe 38 to cam the compression shaft 44 in an axial direction so that it projects relatively further outwardly from the thread protector device in the axial sense. This movement of the compression shaft 44 forces the compression plate 56 to compress the several gripping discs 60 and thereby expand them into tight frictional engagement with the internal wall of the pipe section 12. The thread protector device 10 is thus locked on the end of the pipe and can be retained in this position as long as it is desired to protect the threads carried on the pipe.

When it is desired to release the thread protector device from the pipe end, the lanyard 48 which is secured to the end of the camming arm 40 can be pulled to cause the camming arm to pivot from the position shown in FIG. 3 to the release position in which it extends predominately axially with respect to the pipe section 12 and thread protector device 10. This movement of the camming arm 40 has the effect previously described. Thus, the expandible elastomeric gripping discs 60 are permitted to contract out of frictional contact with the internal wall of the pipe section 12, thereby permitting the thread protector device 10 to fall freely from the end of the pipe section 12.

If it should be desired at this time to move the thread protector device to an out-of-the-way location, the hook 41 carried on the camming arm 40 can be hooked over a wire line which is usually located adjacent the platform of a drilling rig, and the entire thread protector device allowed to slide down the wire line to an out-of-the-way location.

THE EMBODIMENT SHOWN IN FIG. 5

Figure 5:
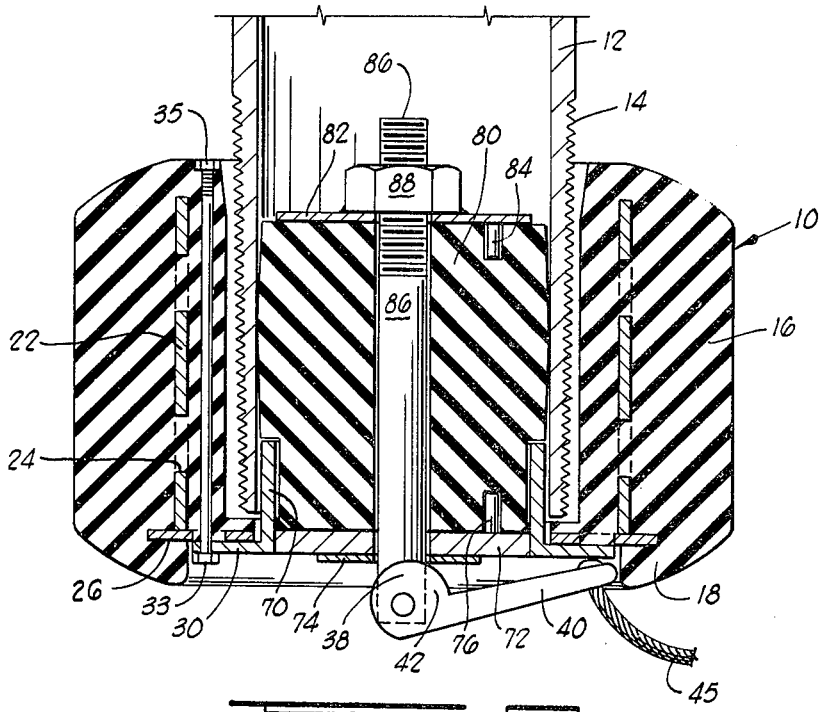
FIG. 5 is a view similar to FIG. 3, but illustrating, in section, a modified embodiment of the pipe thread protector device.

An alternate embodiment of the invention is shown in FIG. 5. Since a number of the elements employed in the alternate embodiment of the thread protector device are identical to those which have been described in referring to the embodiment illustrated in FIGS. 1–4, identical reference numerals have been used to identify such identical elements. Thus, the pipe thread protector device illustrated in FIG. 5 includes a sleeve 16 formed of a body of elastomeric material which surrounds the threads 14 on the end of a section of pipe 12. The thread protector device includes the axially extending metallic reinforcing tube 22, previously described, which is embedded in the body of elastomeric material and retained in position by perforations or apertures 24 through which the elastomeric material extends. The reinforcing tube 22 is secured at its end adjacent the end of the pipe to an annular plate 26 which is attached to one side of an annular base flange 30. As previously described, the annular base flange 30 and the annular plate 26 are secured against one end of the elastomeric body making up the sleeve 16 by means of elongated bolts 33 which are passed through the base flange and annular plate and through the body of elastomer to a location where the threaded ends of the bolt receive nuts 35.

The annular base flange 30 is secured to, or formed integrally with, a rigid internal sleeve 70 which is diametrically dimensioned to easily pass inside the pipe 12 through the open end of the pipe. A base plate 72 is secured across the opening into the rigid internal sleeve 70 and has a cam disc 74 secured to the outer side thereof. One or more retainer pegs 76 are secured to the upper side of the base plate 72 and project axially within the rigid internal sleeve 70. The retainer pegs 76 function, in conjunction with the internal sleeve 70, to retain in position concentrically within, and spaced radially inwardly from, the sleeve 16, an expandable compression block 80 of elastomeric material.

At the opposite side of the compression block 80 from the base plate 72, a flat compression plate 82 bears against a planar end face of the compression block and is keyed to the compression block by a key 84 which projects axially into the compression block from the compression plate. The compression plate 82 is provided with a central aperture through which is extended the threaded end portion of an elongated compression bolt 86. A nut 88 is threaded on the end of the compression bolt 86 to a point where it bears against the compression plate 82, and is preferably soldered, welded or otherwise secured to the compression plate. The compression bolt 84 projects through a central bore formed along the axis of the compression block 80 and projects through aligned central openings in the base plate 72 and in the cam disc 74.

The camming arm 40 which is provided in the embodiment of the pipe thread protector shown in FIG. 5 is constructed identically to the camming arm employed in the embodiment shown in FIGS. 1–4. Thus, it includes a bifurcated end portion 42 having formed thereon, a cam lobe 38 which is in camming engagement with the cam disc 74. At its end opposite the bifurcated end portion 42, the camming arm has a lanyard 45 secured thereto.

OPERATION OF THE EMBODIMENT SHOWN IN FIG. 5

The pipe thread protector shown in FIG. 5 is operated substantially identically to that illustrated in FIGS. 1–4. Thus, prior to the time that the pipe thread protector is placed in its operative position on the end of the pipe section 12, the camming arm 40 is pivoted downwardly from the position illustrated in FIG. 5 so that the compression bolt 86 is free to move upwardly in an axial direction relative to the base plate 72. Axial movement of the compression bolt 86 in this direction relieves the compressive force applied to the expandable compression block 80, and the rubber or other elastomeric material in this compression block can contract radially inwardly to its relaxed, unexpanded state. The expandable compression block 80, in its unexpanded and uncompressed state, has a diameter such that it can pass freely inside the pipe. In this status, the pipe thread protector device 10 can then be placed on the pipe 12 by passing the sleeve 16 around the outer side of the end of the pipe in a position to protect the threads 14. The placement of the pipe thread protector device 10 on the threaded end of the pipe 12 is completed at a time when the pipe end abuts the small amount of elastomer which overlies the base flange 30.

When the pipe protector device is thus positioned, the camming arm 40 is pivoted to the position shown in FIG. 5. In undergoing such pivotation, the cam lobe 38 bears against the cam disk 74 and effectively draws the compression bolt 86 in an axial direction toward the end of the pipe 12. This movement of the compression bolt 86 forces the compression plate 82 against the flat inner side of the expandable compression block 80. That portion of the compression block 80 which is confined between the compression plate 82 and the base plate 72 and rigid internal sleeve 70 is thus caused to undergo radial expansion until it is wedged tightly against the inner wall of the pipe. The thread protector device 10 is now secured in its operative and thread-protective position. The cam lobe 38 is configured so that, in this position of the camming arm 40, the arm is frictionally and by the compression loading, retained in the position illustrated in FIG. 5. It will be noted that in the threaded protective position, the sleeve 16 extends completely around and protects the threads on the outer periphery of the pipe from contact with external objects.

At a time when it is desired to release the thread protector device 10 from engagement with the pipe 12, the lanyard 45 can be pulled to cause the camming arm 40 to pivot downwardly with respect to the position it is shown as occupying in FIG. 5. This will allow the compression bolt 86 to move axially inwardly into the pipe, thereby relieving the compression on the compression block 80 and permitting it to retract out of engagement with the internal wall of the pipe. The pipe thread protector is thus released from engagement with the pipe, and, if desired, it can be removed from the situs by hooking the hook 41 carried on one end of the camming arm 40 to a suitable available wire line and allowing the thread protector to slide to a remote, out-of-the-way location.

EMBODIMENT OF FIG. 6

Figure 6:
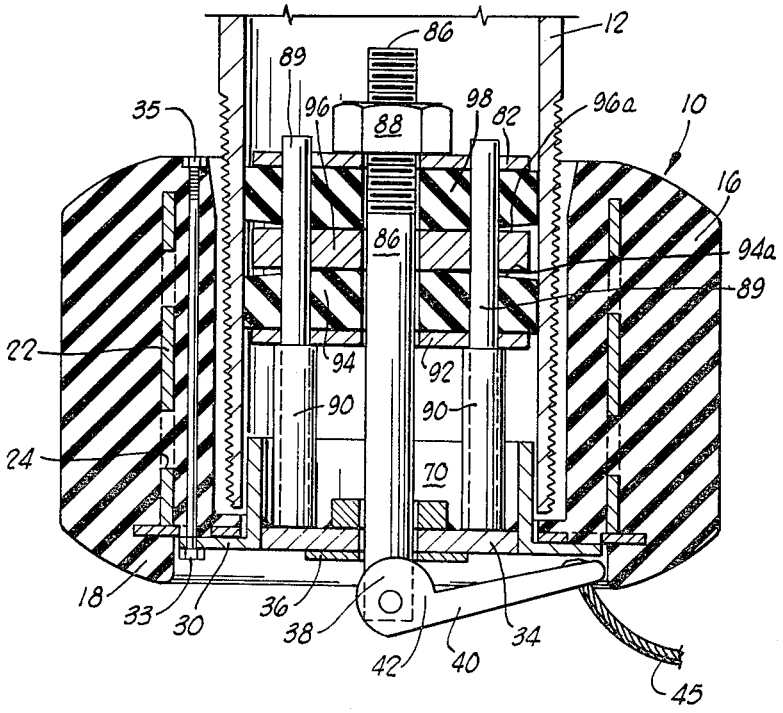
FIG. 6 is a view similar to FIGS. 3 and 5, but illustrating yet another embodiment of the invention.

Yet another embodiment of the invention is illustrated in FIG. 6 of the drawings. Again, identical reference numerals are employed to identify parts and elements of the thread protector device which are identical to the same parts or elements as shown in the two previously described embodiments.

In the embodiment of FIG. 6, the compression shaft 86 which is pivotally connected at its lower end to the camming arm 40 projects at its upper end through a compression plate 82 and carries on the threaded upper end portion, a nut 88 which is secured to the compression plate. A pair of guide posts 89 are secured to, and project upwardly from, the web plate 34. Each guide post 89 has a spacer tube 90 surrounding it, and at their upper ends the tubes 90 support a back-up plate 92. An expandable compression disc 94 is flatly abutted against the back-up plate 92 and is suitably apertured to allow the shaft 86 and posts 89 to pass therethrough. An intermediate compression plate 96 apertured to pass the shaft 86 and posts 89, is positioned between the expandable compression disc 94 and a second expandable compression disc 98. The intermediate compression plate 96 has its opposite surfaces **96*a* in contact with the respective expandable compression discs 94 and 98. The expandable compression discs 94 and 98 are made of elastomeric material. The second or axially inner compression disc 98 bears against one side of the compression plate 82**.

The manner of utilization of the embodiment of the thread protector apparatus shown in FIG. 6 is substantially identical to the embodiments of the invention shown in FIGS. 1-5 and hereinbefore described. Thus, pivotation of the camming arm 40 causes axial movement of the compression bolt 86 to place the compression discs 94 and 98 in compression, thereby causing their radial expansion into frictional engagement with the internal wall of the pipe 12. Release of the thread protector device from the pipe 12 is caused to occur by pivotation of the camming arm 40 in the opposite direction.

Figure 7:
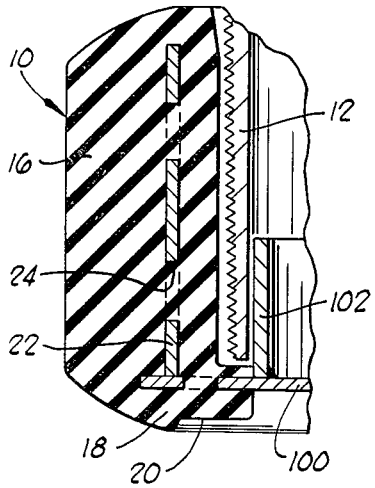
FIG. 7 is a detailed sectional view which illustrates a variation in the construction of one portion of the pipe thread protector device of the invention which is at variance from the manner in which this particular portion is constructed in the embodiment of the invention illustrated in FIGS. 1–6.

In FIG. 7 of the drawings, a portion of a pipe thread protector constructed in accordance with the invention is illustrated in order to portray a slight structural modification which can be effected in the protector. Thus, a base closure plate 100 is provided which extends completely across and closes the opening defined within the skirt 18 carried on the sleeve 16. The outer periphery of the base closure plate 100 is embedded within the elastomeric material of which the sleeve 16 is made, thus eliminating the need for the use of the bolts 33 and nuts 35 as shown in FIG. 6. The base closure plate 100 has secured thereto an axially projecting sleeve 102 which takes the place of, and corresponds in function to, the sleeve 70 as shown in FIG. 6. The base closure plate 100 takes the place of and fulfills the functions of the web plate 34 employed in the other embodiments of the invention which have been hereinbefore described.

EMBODIMENT OF THE INVENTION ILLUSTRATED IN FIGS. 8–10

Figure 8:
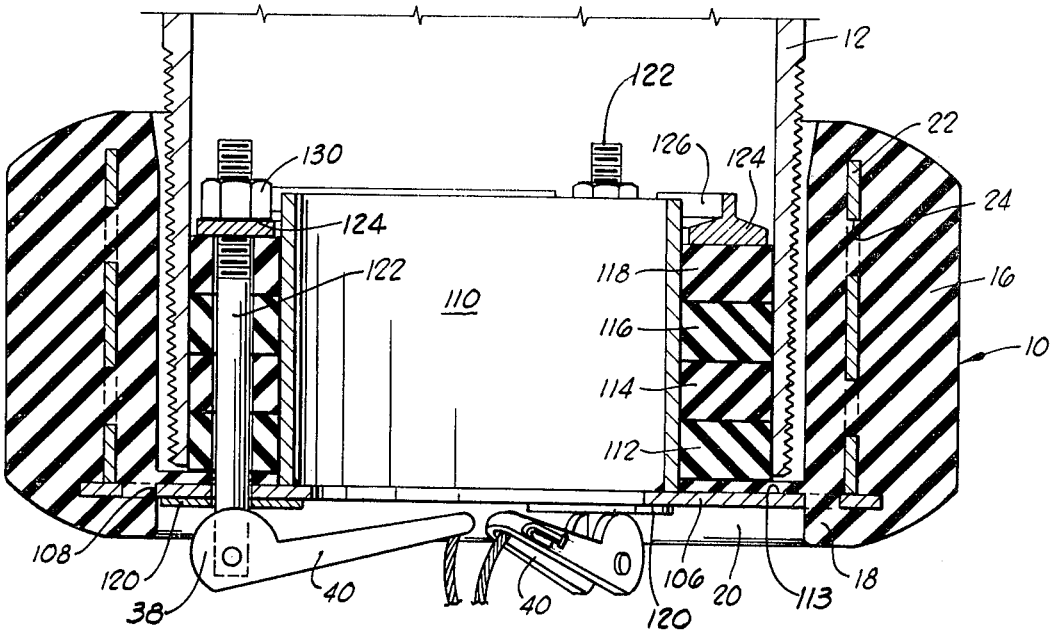
FIG. 8 is a vertical sectional view similar to FIGS. 3 and 5, but illustrating yet another embodiment of the invention which is particularly adapted for use in protecting the threads formed externally on an especially large diameter pipe section.
Figure 9:
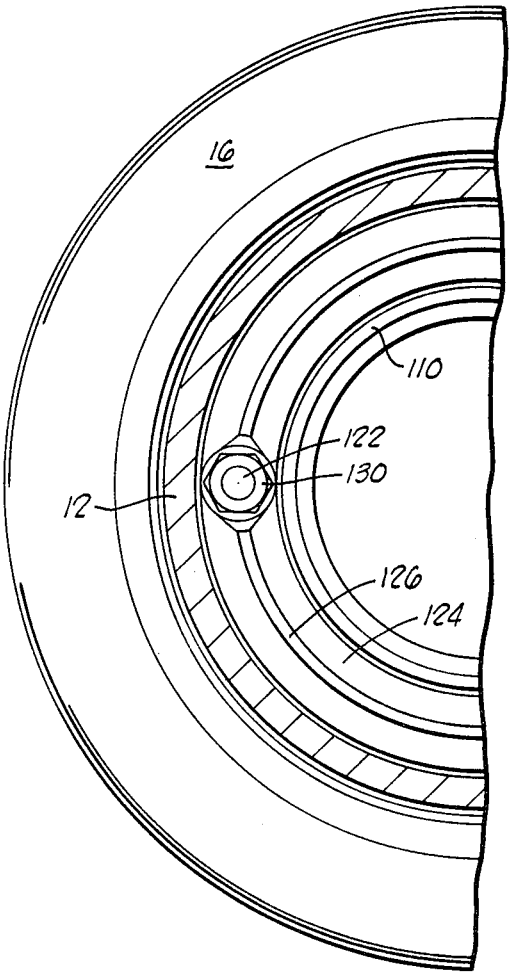
FIG. 9 is a partial top plan view illustrating the appearance of the thread protector device shown in FIG. 8 as it appears when viewed from above, and at a time when the thread protector device is removed from the pipe.
Figure 10:
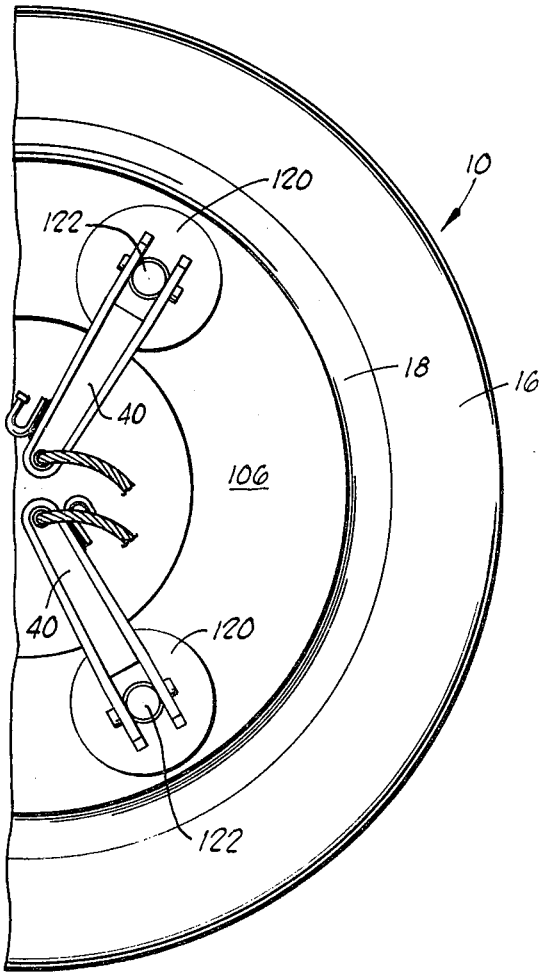
FIG. 10 is a partial bottom plan view illustrating the appearance of a part of the lower side of the pipe thread protector device illustrated in FIG. 8.

In FIGS. 8–10 an embodiment of the pipe thread protector device of the invention which is particularly useful in protecting threads carried by large diameter pipe is illustrated. The thread protector structure includes the annular sleeve 16 of elastomeric material which is dimensioned to concentrically surround the pipe thread in the manner hereinbefore described. The sleeve 16 carries an axially projecting skirt 18 at one end thereof, with the skirt defining an opening 20, also previously described. The opening 20 is partially closed by a base ring 106 which extends partially transversely across, and normal to, the axes of the annular sleeve 16 and of the pipe 12. The base ring 106 has a large central opening and the perforations 108 adjacent its outer periphery which permit it to be interlocked with the elastomer of the sleeve 16 at the location where the outer peripheral portion of the closure plate extends into the elastomer. An axially extending, annular metallic reinforcing tube 22 having apertures 24 therein, as hereinbefore described, is embedded in the elastomer of the sleeve 16 and has one of its ends secured to the base ring 106.

A rigid metallic guide cylinder 110 is positioned concentrically within the sleeve 16 and has one of its ends secured to the base ring 106. The guide cylinder 110 projects axially into the pipe 12 when the thread protector is in place, and is diametrically dimensioned to define an annulus with the internal wall of the pipe 12. A plurality of expandable compression rings 112, 114, 116 and 118 are stacked upon each other in superimposed relation surrounding the guide cylinder 110, with the compression ring 112 resting upon the elastomeric flange 113 backed and supported by the base ring 106.

Circumferentially spaced around the base ring 106 at arcuate intervals of 120° are a plurality of flat cam discs 120. Each of the cam discs 120 bears against the outer side of the base ring 106 and is centrally apertured to permit extension therethrough, and through an aligned aperture in the base ring 106, of a compression shaft 122. There are, of course, three of the compression shafts corresponding in number to the number of cam discs 120.

Each compression shaft 122 extends substantially parallel to the axis of the thread protector 10 and passes through a series of aligned apertures formed in the several expandible compression rings 112, 114, 116 and 118. Each compression shaft 122 terminates at its axially inner end in a threaded end portion which passes through an aperture formed in a rigid annular compression plate 124. The annular compression plate 124 has a flat side bearing upon the uppermost of the compression rings 118, and at its axially inner side has a reinforcing rib 126 which is interrupted at the places where apertures are formed through the compression ring to facilitate passage of the respective compression shafts 122 therethrough. Each of the compression shafts carries a compression nut 130 threaded upon its threaded end portion and bearing flatly against the relieved portion of the annular compression plate 124 where the rib 126 is interrupted.

In order to effect compression of the several expandible compression rings 112-118 positioned within the annulus between the internal wall of the pipe 12 and the metallic guide cylinder 110, each of the compression shafts is pivotally connected to a camming arm 40 which is substantially identical to the camming arms 40 previously described in referring to the other embodiments of the invention. Each camming arm 40 thus includes the cam lobe 38 at the bifurcated end thereof which is configured and positioned to bear against, and operatively cooperate with, the respective cam disc 120.

The embodiment of the invention shown in FIGS. 8–10 is constructed especially for use in relatively large diameter pipe. Thus, several of the cam arms 40 are provided and project out into the central opening formed within the base ring 106 so that the cam arms can be easily grasped and manipulated. It will be perceived that compressive force can be applied to the several annular expandible compression rings 112, 114, 116 and 118 at several points therearound, thus evenly distributing the compressive force over the large expanse of each of these large elastomeric compression rings. In this way, an even gripping force can be applied to the internal wall of a large pipe to retain the thread protector in position. The manner in which the cam arms 40 are manipulated is, in each case, substantially identical to the method of manipulation of the cam arms hereinbefore described.

Although certain preferred embodiments of the invention have been hereinbefore described, it will be understood that various changes and innovations in the illustrated and described structures can be effected without departure from the basic principles which underlie the invention. Changes and innovations of this type are therefore deemed to be circumscribed by the spirit and scope of the invention except as the same may be necessarily limited by the appended claims or reasonable equivalents thereof.

What is claimed is:

1. A device for protecting pipe threads comprising:

an annular elastomeric sleeve dimensioned to surround a pipe thread to be protected;

stop means connected to an end of said sleeve for limiting axial movement of the sleeve on a pipe; and a radially expandable internal gripping subassembly carried on said stop means, and extending into said annular elastomeric sleeve from said end thereof for gripping the inner surface of a pipe upon which said thread protector device is mounted, said gripping subassembly comprising:

a pair of radially expandable, elastomeric gripping elements each constituting a compression disc, and each having a convexly curved surface facing the other of said elastomeric gripping elements;

a rigid compression plate having said elastomeric gripping elements disposed on opposite sides thereof with the convexly curved surfaces of the gripping elements in contact with said compression plate, said rigid compression plate having a central aperture therethrough;

a compression shaft extending through the center of said radially expandable elastomeric gripping elements and through the central aperture in said rigid compression plates;

means adjacent an end portion of the compression shaft for transmitting axial movement from the compression shaft to said gripping elements; and manually operable camming arm means connected to the compression shaft and operative to cam the compression shaft into axial movement upon actuation of the camming arm means;

a pair of guide posts each having one end secured to said stop means and projecting in an axial direction therefrom through said compression discs and said compression plate;

a pair of spacer tubes around said guide posts and each having an end bearing against said stop means; and a back-up plate bearing against the ends of said spacer tubes opposite their ends which bear against said stop means, and flatly abutting the one of said compression discs closest to said stop means.

2. A device for protecting pipe threads comprising:

an annular elastomeric sleeve dimensioned to surround a pipe thread to be protected;

stop means connected to an end of said sleeve for limiting axial movement of the sleeve on a pipe; and a radially expandable internal gripping subassembly carried on said stop means, and extending into said annular elastomeric sleeve from said end thereof for gripping the inner surface of a pipe upon which said thread protector device is mounted, said gripping subassembly comprising:

a pair of radially expandable, elastomeric gripping elements each constituting a compression disc, and each having a convexly curved surface facing the other of said elastomeric gripping elements;

a rigid compression plate having said elastomeric gripping elements disposed on opposite sides thereof with the convexly curved surfaces of the gripping elements in contact with said compression plate, said rigid compression plate having a central aperture therethrough;

a compression shaft extending through the center of said radially expandable elastomeric gripping elements and through the central aperture in said rigid compression plates;

means adjacent an end portion of the compression shaft for transmitting axial movement from the compression shaft to said gripping elements; and manually operable camming arm means connected to the compression shaft and operative to cam the compression shaft into axial movement upon actuation of the camming arm means;

a pair of guide posts each having one end secured to said stop means and projecting in an axial direction therefrom through said compression discs and said compression plate; and back-up plate means cooperating with said guide posts and having one end bearing against said stop means and further having a portion flatly abutting one of said compression discs closest to said stop means, said back-up plate means including:

a back-up plate immediately adjacent and abutting one of said compression discs on the opposite side of said compression disc from said rigid compression plate; and tubular spacer tubes surrounding each of said guide posts and having one end in abutting contact with said back-up plate and the other end bearing against said stop means.

3. A device for protecting pipe threads comprising:

an annular elastomeric sleeve dimensioned to surround a pipe thread to be protected;

stop means connected to an end of said sleeve for limiting axial movement of the sleeve on a pipe, said stop means comprising:

an annular plate extending transversely to the axis of said sleeve and having an outer peripheral portion projecting into, and embedded in, the elastomer of the sleeve;

an annular base flange detachably secured to said annular plate and projecting radially inwardly therefrom; and a web plate extending diametrically across said sleeve and having its opposite ends secured to said annular base flange, said web plate having a central aperture therein;

a radially expandable internal gripping subassembly carried on said stop means, and extending into said annular elastomeric sleeve from said end thereof for gripping the inner surface of a pipe upon which said thread protector device is mounted, said gripping subassembly comprising:

at least one radially expandable, elastomeric gripping element;

a compression shaft extending through said gripping elements and extending through said central aperture in said web plate;

means adjacent an end portion of the compression shaft for transmitting axial movement from the compression shaft to said gripping elements; and manually operable camming arm means connected to the compression shaft and operative to cam the compression shaft into axial movement upon actuation of the camming arm means.

4. A device for protecting pipe threads comprising:

an annular elastomeric sleeve dimensioned to surround a pipe thread to be protected;

stop means connected to an end of said sleeve for limiting axial movement of the sleeve on a pipe; and a radially expandable internal gripping subassembly carried on said stop means, and extending into said annular elastomeric sleeve from said end thereof for gripping the inner surface of a pipe upon which said thread protector device is mounted, said gripping subassembly comprising:

a plurality of contiguous elastomeric, radially expandable compression rings arrayed concentrically within said sleeve and in axial alignment with each other, one of said compression rings bearing against said stop means;

a plurality of compression shafts each extending parallel to the axis of said sleeve and each spaced radially therefrom, each of said compression shafts projecting through aligned apertures in said compression rings;

means adjacent an end portion of said compression shafts for transmitting axial movement from the compression shafts to said compression rings; and manually operable camming arm means connected to each of said compression shafts and operative to individually and independently cam each of the respective compression shafts into axial movement upon actuation of the respective camming arm means; and a rigid guide cylinder positioned concentrically within the sleeve and within the compression rings for guiding and aligning the compression rings, said rigid guide cylinder terminating at its end closest to said camming arm means within said sleeve and spaced from the end of said sleeve whereby said camming arm means can be folded to a substantially horizontally extending position in which it is located entirely within said sleeve.

5. A device as defined in claim 4 wherein said axial movement transmitting means comprises:

an annular compression plate axially aligned with said compression rings, and bearing against another of said compression rings axially spaced from said one compression ring, said annular compression plate having an end portion of each of said compression shafts extending therethrough; and nuts threaded on said end portions of each of said compression shafts and retaining said compression plate in contact with said other of said compression rings.

6. A device for protecting pipe threads comprising:

an annular elastomeric sleeve dimensioned to surround a pipe thread to be protected;

stop means connected to an end of said sleeve for limiting axial movement of the sleeve on a pipe; and a radially expandable internal gripping subassembly carried on said stop means, and extending into said annular elastomeric sleeve from said end thereof for gripping the inner surface of a pipe upon which said thread protector device is mounted, said gripping subassembly comprising:

at least one radially expandable, elastomeric gripping element;

a compression shaft extending through said gripping elements;

means adjacent an end portion of the compression shaft for transmitting axial movement from the compression shaft to said gripping elements;

manually operable camming arm means connected to the compression shaft and operative to cam the compression shaft into axial movement upon actuation of the camming arm means; and a rigid compression plate having a central aperture therethrough receiving said compression shaft; and a pair of said gripping elements disposed on opposite sides of, and in contact with, said compression plate, each of said gripping elements in said pair being an elastomeric compression disc having said compression shaft projecting through the center thereof, and having a convexly curved surface in contact with said compression plate.

7. A device for protecting pipe threads comprising:

an annular elastomeric sleeve dimensioned to surround a pipe thread to be protected;

stop means connected to an end of said sleeve for limiting axial movement of the sleeve on a pipe; and a radially expandable internal gripping subassembly carried on said stop means, and extending into said annular elastomeric sleeve from said end thereof for gripping the inner surface of a pipe upon which said thread protector device is mounted, said gripping subassembly comprising:

at least one radially expandable, elastomeric gripping element;

a compression shaft extending through said gripping elements and having an end portion;

a rigid sleeve projecting axially from said stop means into the interior of said elastomeric sleeve and spaced radially inwardly therefrom;

a radially inwardly directed flange secured to the axially inner end of said rigid sleeve and having one of said elastomeric gripping elements abutting thereagainst;

a nut threaded on said end portion of said compression shaft;

a compression plate between said nut and said gripping elements, and located on the opposite side of said gripping elements from said radially inwardly directed flange whereby axial movement of said compression shaft in one direction will cause axially oppositely acting forces to be exerted on said gripping elements by said inwardly directed flange and said compression plate to cause said gripping elements to undergo radial expansion;

manually operable camming arms means connected to the compression shaft and operative to cam the compression shaft into axial movement upon actuation of the camming arm means; and an annular cage element secured to said compression plate at a location concentrically surrounding said compression shaft and diametrically dimensioned for reciprocating movement within said radially inwardly directed flange, said cage element, compression plate and radially inwardly directed flange cooperating to confine said gripping elements at the axially opposite sides thereof and at the radially inner side thereof whereby when said nut is threaded on said compression shaft to move said compression plate in an axial direction to compress said gripping elements, expansion of said gripping elements can only occur in a radially outward direction.

8. A device for protecting pipe threads comprising:

an annular elastomeric sleeve dimensioned to surround a pipe thread to be protected;

stop means connected to an end of said sleeve for limiting axial movement of the sleeve on a pipe, said stop means comprising:

an annular plate extending transversely to the axis of said sleeve and having an outer peripheral portion projecting into the elastomer of the sleeve;

an annular base flange secured to said annular plate and projecting radially inwardly therefrom; and a web plate extending diametrically across said sleeve and having its opposite ends secured to said annular base flange, said web plate having a central aperture therein for accommodating extension of a compression shaft therethrough;

a radially expandable internal gripping subassembly carried on said stop means, and extending into said annular elastomeric sleeve from said end thereof for gripping the inner surface of a pipe upon which said thread protector device is mounted, said gripping subassembly comprising:

a plurality of substantially identically sized, radially expandable, elastomeric gripping discs;

a plurality of annular metallic washers, each of which is positioned between a pair of said gripping discs;

a compression shaft extending through said gripping discs and through said central aperture in said web plate;

means adjacent an end portion of said compression shaft for transmitting axial movement from the compression shaft to said gripping discs; and manually operable camming arm means connected to the compression shaft and operative to cam the compression shaft into axial movement upon actuation of the camming arm means; and an annular metallic reinforcing sleeve projecting coaxially within said elastomeric sleeve.

9. Pipe thread protector apparatus comprising:

an elastomeric annular sleeve;

a rigid plate extending in a plane extending substantially normal to the axis of the sleeve, and located at one end of the sleeve;

elastomeric material positioned within the sleeve and spaced radially inwardly therefrom to define an annulus with the sleeve for receiving a threaded pipe end;

means for expanding the elastomeric material within the sleeve radially outwardly to thereby reduce the transverse width of the annulus and engage a pipe end positioned therein, said expanding means comprising:

means for applying an axially acting force to the elastomeric material within the sleeve to urge it in the direction of said rigid plate;

static means bearing against the opposite side of said elastomeric material from said force applying means for preventing movement of said elastomeric material toward said plate; and cam means for actuating said force applying means and including manually operable cam arm means operatively connected to said rigid plate; and bolts extending through said rigid plate and axially through the elastomer of said annular sleeve to detachably fasten said plate to said annular sleeve whereby the elastomeric material positioned within the sleeve and the means for expanding the elastomeric material positioned within the sleeve can be detached from the annular sleeve and removed from the interior of the pipe and the interior of the annular sleeve to facilitate maintenance and replacement of said elastomeric material positioned within the sleeve and said means for expanding said elastomeric material located within the sleeve.

* * * * *